US009761363B2

(12) United States Patent
Golz

(10) Patent No.: US 9,761,363 B2
(45) Date of Patent: Sep. 12, 2017

(54) ELECTROMAGNETIC ACTUATING APPARATUS

(71) Applicant: ETO Magnetic GmbH, Stockach (DE)

(72) Inventor: Thomas Golz, Sipplingen (DE)

(73) Assignee: ETO Magnetic GmbH, Stockach (DE)

( * ) Notice: Subject to any disclaimer, the term of this patent is extended or adjusted under 35 U.S.C. 154(b) by 0 days.

(21) Appl. No.: 14/889,449

(22) PCT Filed: Apr. 3, 2014

(86) PCT No.: PCT/EP2014/056759
§ 371 (c)(1),
(2) Date: Nov. 6, 2015

(87) PCT Pub. No.: WO2014/180607
PCT Pub. Date: Nov. 13, 2014

(65) Prior Publication Data

US 2016/0099096 A1 Apr. 7, 2016

(30) Foreign Application Priority Data

May 8, 2013 (DE) ..... 20 2013 102 019

(51) Int. Cl.
*H01F 5/00* (2006.01)
*H01F 7/08* (2006.01)
(Continued)

(52) U.S. Cl.
CPC ..... *H01F 7/08* (2013.01); *H01F 7/06* (2013.01); *F01L 2013/0052* (2013.01); *H01F 2007/062* (2013.01)

(58) Field of Classification Search
CPC ..... H01F 2007/062
(Continued)

(56) References Cited

U.S. PATENT DOCUMENTS 2,683,785 A * 7/1954 Miller ..... H01H 50/12 174/151
3,493,903 A * 2/1970 Kosar ..... H01H 50/58 335/135
(Continued)

FOREIGN PATENT DOCUMENTS

CN 101089439 A 12/2007
CN 101689419 A 3/2010
(Continued)

OTHER PUBLICATIONS

International search report for Apln No. PCT/EP2014/056759 dated Jul. 31, 2014.
(Continued)

*Primary Examiner* — Shawki S Ismail
*Assistant Examiner* — Lisa Homza
(74) *Attorney, Agent, or Firm* — Bachman & LaPointe, PC

(57) ABSTRACT

An electromagnetic actuating apparatus having an armature unit (14) which can move along an axial direction (10) in response to current applied to a stationary coil unit and designed to interact with an actuating partner, wherein the coil unit has a winding (22) with which a connection contact (26) can make contact. The coil unit is accommodated in a housing (12) which surrounds the coil unit at least in sections. The coil unit has an electrical connection for connecting the connection contact to a plug section (18, 20) on the housing. The connection contact (26), together with a flat end section (30) of the electrical connection, which is oriented parallel to the connection contact and is permanently connected to the connection contact, extends at least in sections parallel to the axial direction (10) or is angled out of a position of extent in this direction after connection,
(Continued)

wherein the housing end region is axially opposite a housing outlet for the armature unit (14).

15 Claims, 1 Drawing Sheet

(51) Int. Cl.
*H01F 7/06* (2006.01)
*F01L 13/00* (2006.01)

(58) Field of Classification Search
USPC ..... 335/282
See application file for complete search history.

(56) References Cited

U.S. PATENT DOCUMENTS 3,750,060 A * 7/1973 Pfenning ..... H01H 50/56 200/283
3,800,250 A * 3/1974 Mori ..... H01H 50/645 335/128
4,893,102 A * 1/1990 Bauer ..... H01H 50/305 335/132
5,160,910 A * 11/1992 Tsuji ..... H01H 50/642 335/121
5,204,647 A * 4/1993 Mitsuki ..... H01H 50/642 335/128
5,907,268 A * 5/1999 Mader ..... H01H 50/042 335/130
6,075,429 A * 6/2000 Uotome ..... H01H 50/645 335/129
6,731,190 B2 * 5/2004 Yamashita ..... H01H 50/443 335/282
6,967,550 B2 11/2005 Elendt et al.
7,710,224 B2 * 5/2010 Gruner ..... H01H 51/2281 335/129
7,994,884 B2 * 8/2011 Kuo ..... H01H 50/026 335/78
8,063,726 B2 11/2011 Stehle
8,138,440 B2 * 3/2012 Onufriyenko ..... H01H 73/045 218/154
8,176,887 B2 5/2012 Golz
8,179,217 B2 * 5/2012 Kawaguchi ..... H01F 7/1615 335/124
8,448,615 B2 5/2013 Laufenberg et al.
9,076,617 B2 * 7/2015 Yamashita ..... H01H 9/40
9,136,080 B2 * 9/2015 Sumino ..... H01H 50/20
9,437,382 B2 * 9/2016 Kato ..... H01F 5/04
2004/0080389 A1 * 4/2004 Nishida ..... H01H 50/026 335/132
2011/0210277 A1 9/2011 Bender

FOREIGN PATENT DOCUMENTS

CN 102187407 A 9/2011
CN 102395762 A 3/2012
DE 102 40 774 4/2003
DE 10 2007 028 600 12/2008
EP 2590184 A1 8/2013
WO 03/021612 3/2003
WO 2012017918 A1 2/2012

OTHER PUBLICATIONS

Chinese Office Action for Application No. 201480025926.4 dated Sep. 10, 2016.

* cited by examiner

ELECTROMAGNETIC ACTUATING APPARATUS

BACKGROUND OF THE INVENTION

The present invention relates to an electromagnetic actuating apparatus. Such electromagnetic actuating apparatuses which,—generically—are described for instance in DE 102 40 774 A1 of the applicant, are used for a variety of applications, wherein in particular the use as actuator for a camshaft adjustment device of a motor vehicle engine represents a preferred field of use. Here, for instance, the armature unit (typically constructed in the manner of a tappet) interacts with an end-side engagement region with an associated actuating groove or suchlike actuating partner of the internal combustion engine.

Not least owing to the characteristics due to structural space in such a location of use, the installation geometry of a known electromagnetic actuating apparatus of the generic type is frequently important; for instance in the example case of application of the camshaft adjustment and a plurality of actuators provided adjacent to one another (and typically with tappets aligned parallel to one another), radial dimensions (i.e. running transversely to a direction of movement) which are as compact as possible are a particular concern here, in order to be able to place for instance adjacent actuators are close to one another as possible; such a configuration then enables for instance the carrying out of several different actuation operations at the actuating partner, for instance the engaging in or respectively interacting with a plurality of actuating grooves provided adjacent to each other.

The geometric dimensions of generic electromagnetic actuating apparatuses can not, however—as a matter of principle—be minimized arbitrarily, thus for instance electromagnetic actuating forces of such an apparatus which are to be achieved, predetermined dynamic characteristics (actuating times) or suchlike constraints determine necessary minimum dimensions of the electromagnetic components which are involved.

Accordingly, it is important that other assemblies, for instance an enclosed housing or suchlike do not bring any significant (for instance radial) increase in dimension, so as not to have a disadvantageous influence on the compactness of a desired arrangement on electromagnetic actuating apparatuses, for instance a plurality of actuators which are to be provided adjacent to one another with the formation of a minimum spacing.

DE 10 2007 028 600 A1 of the applicant illustrates such a case of application of a plurality of movable armature units (parallel to one another, here); however, the solution described here is special, causes high expenditure in terms of installation and adjustment and is not generally able to be transferred to installation situations which require compact installation dimensions of the electromagnetic actuating apparatuses which are to be used.

The coil units described in this prior art, in this respect generically, also have the disadvantage that the connection contacts associated therewith (not shown in further detail) project radially (i.e. transversely to a respective axial direction of movement of the armature units), with the purpose, due to manufacturing technology, of electrically and mechanically connecting connection contacts, associated with a respective winding, to connecting structures (connecting means) in the respective housing, so that then via these connecting means a coupling can take place to a plug section, provided typically on the edge side on the housing.

Via this plug section (which depending on the purpose of use can be embodied so as to be multipolar, in a bush-like manner or in another suitable manner), the coupling then takes place by means of conventional control wires to suitable control electronics.

In the currently prevailing mass production technology, the described connection between connection contact (the winding), which generally projects radially from the coil former (typically made from plastic), and the connecting means takes place here by a welded connection.

A corresponding welding tongs or suchlike element of an automatic welding machine overlaps, for this purpose, the partners which are to be connected and produces a welded connection in an otherwise known manner.

A disadvantage in this (otherwise proven and effective) method is that through the lateral (radial) projecting of the connection contact together with associated connection partner of the electrical connecting means, an effective diameter of the actuating apparatus is increased in size; thus, indeed, sufficient space must exist from the radial direction for the engagement of the welding device for producing the welded connection. This, in turn, is disadvantageous for the described requirements of compactness, in particular concerning as close and compact a construction density as possible of actuating apparatuses which are, or are to be provided, adjacent to one another.

SUMMARY OF THE INVENTION

Accordingly, it is an object of the present invention to minimize a (necessary) minimum diameter (i.e. a housing extent transversely to the axial movement direction of the armature unit), with the aim of enabling as compact as possible an arrangement of arrangements which are to be provided adjacent to one another.

The problem is solved by the electromagnetic actuating apparatus with the features disclosed herein; advantageous further developments of the invention are also described herein. Additional and independent protection within the scope of the invention is additionally claimed for a production method for producing the electromagnetic actuating apparatus as disclosed herein, with the installation and connection steps which can be seen from the present application documents and are to be deemed to be disclosed as belonging to the invention. Within the scope of the invention, in addition protection is claimed for a use of the electromagnetic actuating apparatus according to the invention in a motor vehicle—or respectively combustion engine installation context, wherein the present invention has proved to be particularly suited to be used and installed for the adjusting of an engine unit, for instance a camshaft (or respectively a camshaft adjustment unit).

In an advantageous manner according to the invention, departing from the generic prior art, the connection contact associated with the coil former (which connection contact itself is in turn connected electrically and mechanically to the coil wire of the winding) is constructed in an extent direction which runs parallel to the axial movement direction of the armature. Parallel to this connection contact (and preferably aligned in a planar manner thereon) a flat end section of the metal connecting means is provided, so that through a radial or respectively lateral application of welding means or suchlike connecting units, then between these conducting sections a permanent mechanical and electrical connection can be produced.

Through the fact that according to the invention this pair of connection partners extends before or respectively during the connection process parallel to the axial direction and not transversely or respectively radially, therefore according to the invention is situated in the region of the housing end region provided opposed by the armature outlet, this connection site does not bring about any radial or respectively cross-sectional widening of the electromagnetic actuating apparatus or respectively the diameter thereof. Rather, according to the invention, this connection site between the connection contact and the flat end section of the connection means remains within the maximum diameter determined by the (typically hollow-cylindrical) housing and the coil former accommodated therein, only in the region of the rearward housing end wall a lengthening of the actuating apparatus takes place which, however, is distinctly less problematic than an increased diameter with regard to compact installation space conditions.

Advantageously according to the invention, in addition the connection thus provided, which is to be produced permanently for instance typically by means of soldering or welding, is to be treated after the connection process additionally in a space-saving manner by folding down or respectively angling, such that the connection pair, which extends in an axially parallel manner before and during the connection process, after completed connection by the folding down or respectively bending around is brought into a position preferably parallel and drawing near to or respectively lying against the associated housing end wall. This then leads to a merely marginal axial lengthening of the unit, so that according to the invention advantageously the present invention contributes significantly to the compactness and hence flexibility in use of generic electromagnetic actuating apparatuses.

In a particularly preferred manner with regard to manufacturing technique, the connection contact, additionally or alternatively also at least the end section of the metal connecting means (again further preferably also the entire metal connecting means within the actuator housing), is realized as a stamped pat. Such stamped parts not only enable a simple and reproducible producibility, also thereby an automated welding or suchlike connection process is simplified.

According to a further development, advantageously and with the purpose of achieving an angling (folding down) of the produced permanent connection which is as simple, as protective of the material and as secure with regard to connection as possible, in a transverse direction, at least one of the connection partners is provided with a suitable bend relief (for instance a targeted material allowance, a shaped curve region or suchlike). Accordingly, then an advantageous folding down would not lead to any material crack or suchlike possible impairment during manufacture.

Whilst it is additionally preferred within the scope of the invention to allow the connection partners, connection contact and end section of the metal connecting means to project out from the housing in an axially parallel manner before or respectively during the connection process (welding or respectively soldering), it is nevertheless included by the present invention to also provide such an arrangement within the housing and then to enable an access via a welding tongs or suchlike through a corresponding opening, recess or suchlike on the end side.

In a particularly preferred manner, the lug- or respectively tongue-like connection contact, preferably realized as a stamped part, is integrated onto or respectively into the coil former; typically by shooting the metal contact material into a plastic which is used for the coil former. Thereby, in a favourable manner with regard to manufacturing technique, the position according to the invention of the connection contact can already be established, namely such that, in relation to a coil former extending coaxially to the armature, the thus fastened connection contact does not project from this coil former radially, but in an end-side axially parallel manner. Corresponding mechanical stresses would then transfer from the connection contact to the coil former, a winding wire suitably connected to the connection contact would, however, remain mechanically unstressed in every state, so that also from this point of view a high-grade, operationally reliable and error-free mounting of the present invention is made possible.

In order to then ensure an additional protection after completed mounting or respectively after the advantageous angling after completed permanent connection, it is preferred according to a further development to cover the associated housing end region by a cover, a cap or suchlike; this, however, also has a correspondingly small axial structural dimension and does not affect a radial diameter of the apparatus.

As a result, through the present invention, the possibility is created in a surprisingly simple and structurally elegant manner, to configure a radial diameter of generic electromagnetic actuating apparatuses so as to be compact to the best possible extent and in particular to move hitherto necessary electrical connection sites, provided radially with respect to the casing side, for coupling the winding to the housing plug section for further external contacting out from the lateral region which is effective with regard to diameter. However, the apparently necessary additional effort of a bending around—or respectively folding down process, which is provided preferably and according to a further development, more than counterbalances the dimension advantages which are achieved in practical use.

If then, as advantageously claimed within the scope of the invention, the electromagnetic actuating apparatus according to the invention is used as a camshaft adjustment device for an internal combustion engine or, in general, as an adjustment unit for an internal combustion engine functionality, in particular in a motor vehicle context, the advantages according to the invention come into operation in particular in that a plurality of such electromagnetic actuating apparatuses according to the invention is mounted adjacent to one another, more preferably touching one another on the casing side. Thus, it is thereby made possible for instance to configure in an even more space-saving manner or respectively to arrange in an even better manner in a tight installation space a movement to and fro, enabled by a pair of known camshaft adjustment devices, of a camshaft along an axial direction through the compact radial dimensions which are made possible according to the invention.

BRIEF DESCRIPTION OF THE DRAWINGS

Further advantages, features and details of the invention will emerge from the following description of preferred example embodiments and with the aid of the drawings.

These show in.

DETAILED DESCRIPTION

Figure 1:
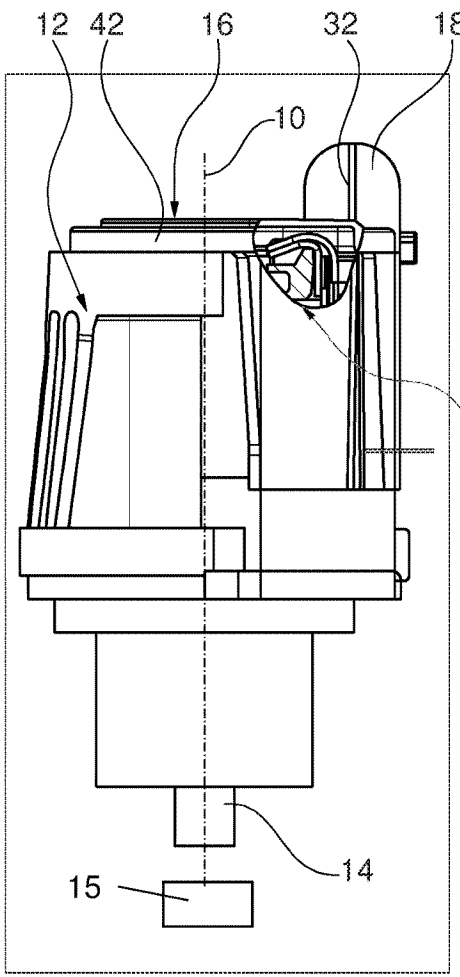
FIG. 1 a diagrammatic side view of the electromagnetic actuating apparatus according to a first embodiment of the invention, wherein in the region of the plug section a cut-out is opened from the housing wall for illustration purposes.

FIG. 1 illustrates in the diagrammatic side view the electromagnetic actuating apparatus according to a first preferred embodiment. An armature unit 14 (shown only with an end-side tappet section) is guided movably along the movement longitudinal axis 10 in a slightly conically widening housing 12 extending radially symmetrically about a symmetry- and movement longitudinal axis 10. The tappet unit is constructed with the shown end-side engagement section for interacting with an actuating partner schematically illustrated at 15. In the illustrated example embodiment, this actuating partner (not part of the invention) is an actuating groove of a device (not shown in any detail) for camshaft adjustment of an internal combustion engine for motor vehicle technology.

Whilst the tappet end 14 of the armature unit emerges at one end on the face side out from the housing (having a plurality of sections extending along the longitudinal axis 10), on the opposite face side 16 a contact—or respectively plug section 18 is constructed, typically by injecting onto the face-side housing (consisting of a plastic material), wherein then in an otherwise known manner this plug section 18 cooperates with correspondingly adapted connection cables, not shown, for connection with control units connected upstream.

In the interior of the housing 10, a coil unit is provided for moving the armature unit 14, which coil unit has a winding 22 formed on a coil former 20 and is held in a stationary manner in the housing 12. Housing sections shown by hatching in FIG. 2 are co-connected in the coil body 20 by injecting around or suchlike manufacturing methods suitable for mass production.

Figure 2:
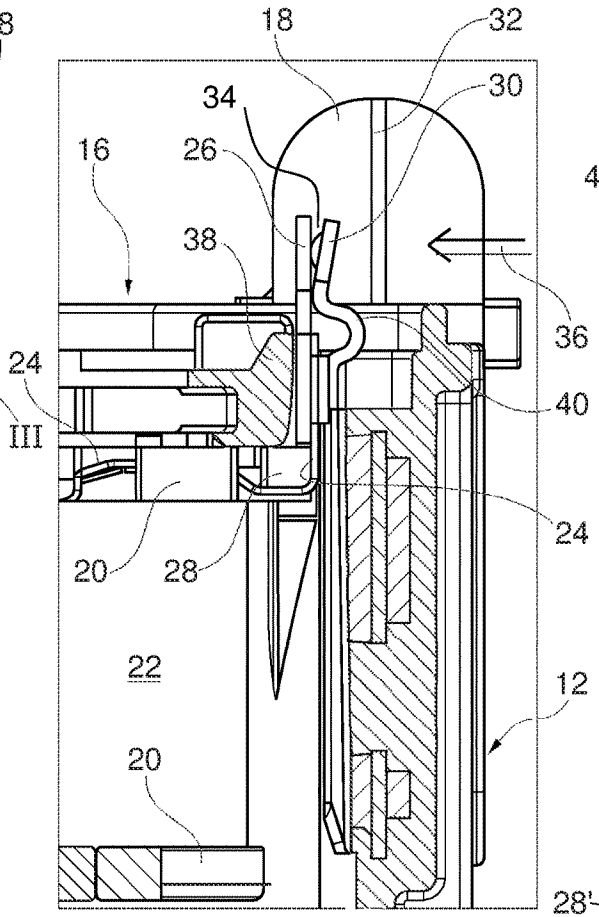
FIG. 2 a longitudinal section detail view of the connection region between the connection contact of the coil winding and the flat end section of the connecting means before a welding operation and in the non-angled state.

The (at least one) winding 22 is realized by a winding wire 24 (FIG. 2), which is guided on the face side of the hollow-cylindrical coil former 20 and is connected permanently to a coil connection contact 26, which (flat and in the manner of a lug) is produced from a suitably stamped metal material and (again by injecting on or respectively around or respectively by shooting into an existing shaped body) projects from an end-side flange section 28 of the coil former 20 in the manner shown in FIG. 2. With the radially symmetrical configuration of the present example embodiment, the coil connection contact 26 thus extends parallel to the longitudinal axis 10 and projects rearward out from the face side 16, as FIG. 2 in the still unconnected (non-welded) state shows.

In this assembly state, as FIG. 2 shows, a flat end section 30 of a metal connector, again executed as a stamped part, is associated with the coil connection contact 26, which connector (through a cable run not shown in closer detail) contacts an electrical connection contact 32 in the plug section 18.

As illustrated by the longitudinal sectional view of FIG. 2, in the non-welded state the contacts 26, 30 stand opposite one another with their flat sides directed to one another and project rearwards out from the face side 16 of the housing 12; accordingly, in a subsequent connection step of these ends (a diagrammatic weld bead or respectively a weld projection 34 is shown here) by lateral (transversely- or respectively radially-running) engagement by means of a welding tongs or suchlike welding unit along the direction of the double arrow 36 a welding of the assemblies 26, 30 can take place, with the aim of producing a permanent, mechanically stable and electrically conducting connection.

Figure 3:
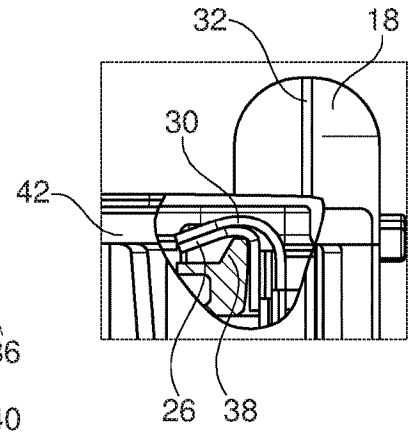
FIG. 3 a side view analogous to FIG. 2 and as an enlarged illustration of FIG. 1, wherein after a connecting, the connection partners are angled in the direction of the housing end region, and FIG. 4 a diagrammatic illustration, presented as a cut-out enlargement, of the connection region in a prior art which is to be drawn upon as generic.
Figure 4:
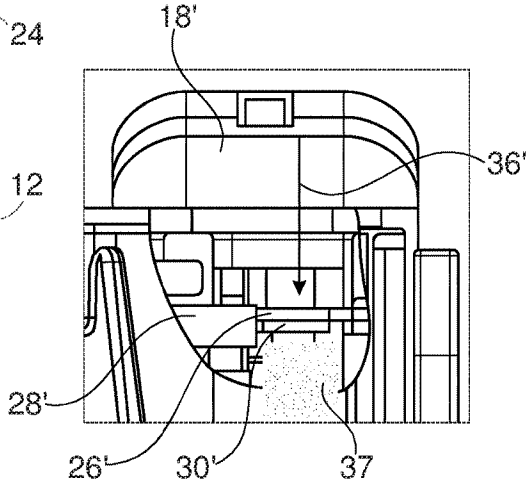
Fig. 4 (Prior Art)

In contrast to the diagram illustrated for comparison in FIG. 4, it becomes clear that the critical step of welding (along arrow direction 36) for an efficient series production is distinctly simplified: In the prior art, which is drawn upon as being generic, in this respect the illustration of FIG. 4 corresponds approximately to the cut-out illustration in FIG. 2, namely both the coil connection contact 26' and also the end section 30' of the associated connecting means as connection partner extends in a horizontal direction on the casing side on the housing. Accordingly, the engagement for welding must take place here along the arrow direction 36', which entails that, illustrated by the diagrammatic surface area 37 in FIG. 4, a corresponding space for this connection process has to be held available radially outwards. Accordingly, the critical radial diameter of the housing 12' (for desired compact dimensions) increases, so that in particular the disadvantage described in the introduction arises that the apparatus according to FIG. 4 is not optimized with regard to compact cross-sectional dimensions and in this respect is only suitable to a limited extent for use in correspondingly cramped installation spaces. The further assemblies which can be seen in FIG. 4 correspond in this respect to FIGS. 1 to 3 and are provided with respect to their equivalence with analogous reference numbers or respectively with an added "'".

The example embodiment which is shown within the scope of the invention now makes it possible to deform the welded connection between the connection partner 26, 30, produced in FIG. 2 advantageously on the face side and hence without the requirement of a radial widening, by angling (bending or respectively folding down) in the direction of the rearward housing face side 16. The cut-out view of FIG. 3 shows a correspondingly deformed state, which in this respect corresponds to the cut-out III in FIG. 1: Bent over an inner housing shoulder 38 provided adjacent to the connection contact 26, a cross-sectionally rounded course is produced of the partners 26, 30 which are securely connected with one another, wherein in the example embodiment which is shown a bend relief region 40, provided on the assembly 30, constructed as a material allowance, facilitates this bending- or respectively folding-down process and in particular prevents the material of the end section 30 (as a flat stamped part) from cracking or being otherwise damaged through the folding-down.

The possible end section of FIG. 3 thereby then also achieves compact dimensions of the housing in axial direction in the region of the rearward face side 16, wherein in a supplementary manner and additionally advantageously after the bending a rearward housing cover 42 can be put in place, with the advantage of creating protection against the penetrating of dirt or impairments at the place of use and of forming a complete, planar rear face of the housing.

Thereby, a maximum circumferential dimension of the thus realized electromagnetic actuating apparatus (for instance at the maximum diameter of the housing section) reaches 12 m, a saving on diameter of approximately 10% compared with the prior art of FIG. 4, which enables new possibilities of use of the invention.

The present invention is not restricted here to the practically shown example embodiment; neither is the practical flat form of realization of the contact partners necessary, nor must a folding down or respectively bending after completed connecting be carried out for instance in the arrow direction shown in FIG. 2 (or at all). The specialist in the art, in accordance with a respective usage requirement, will also configure other elements and assemblies of the invention in a respectively suitable manner.

The invention claimed is:

1. An electromagnetic actuating apparatus having an armature unit (14) which can move along an axial direction (10) in response to current being applied to a stationary coil unit and which is designed to interact with an actuating partner, wherein the coil unit has a winding (22) which is provided on a coil former (20) and with which a connection contact (26) can make contact, and said coil unit is accommodated in a housing (12) which surrounds the coil unit at least in sections, and which has associated electrical connecting means for connecting the connection contact (26) to a plug section (18) which is provided on the housing, wherein the connection contact (26), together with a flat end section (30), which is oriented parallel to said connection contact (26) and is designed to be permanently connected to the connection contact (26) or is permanently connected to the connection contact (26), of the electrical connecting means, extends at least in sections in a direction parallel to the axial direction (10) on or in a housing end region (16) or is angled out of a position of extent of this kind after connection, wherein the housing end region is axially opposite a housing outlet for the armature unit (14), and wherein the connection contact and/or the flat end section has a bend relief region (40), outside a site of connection of the connection contact to the flat end section, which permits an angling of the permanent connection.

2. The apparatus according to claim 1, wherein the connection contact 26 and/or the flat end section (30) of the connecting means is a metal stamped part.

3. The apparatus according to claim 1, further comprising a permanent connection in the form of a welded- or soldered connection (34) between end faces, directed to one another, of the connection contact (26) and the flat end section (30).

4. The apparatus according to claim 3, wherein the permanent connection has a weld projection (34) between the end faces, directed to one another, of the connection contact and the flat end section.

5. The apparatus according to claim 1, wherein the angling of the permanent connection is an angling of the connection by up to 100°.

6. The apparatus according to claim 1, wherein the connection contact (26) for permanent connecting with the end section (30), oriented thereto and extending parallel thereto, emerges at least in a non-angled state out from the end region (16) of the housing or is exposed in the end region so that a welding device for the production of the permanent connection can engage from an engagement direction (36) running transversely to the axial direction.

7. The apparatus according to claim 1, wherein a winding wire (24) of the coil unit is electrically and mechanically connected to the connection contact (26) so that neither permanently connecting with the end section of the connecting means nor angling, subsequent thereto, exerts a mechanical stress, on the winding wire.

8. The apparatus according to claim 1, wherein a winding wire (24) of the coil unit is electrically and mechanically connected to the connection contact (26) so that neither permanently connecting with the end section of the connecting means nor angling, subsequent thereto, exerts a tensile stress, on the winding wire.

9. The apparatus according to claim 1, wherein the winding (22) of the coil former has a section extending along the axial direction and coaxially to the armature unit, which is mechanically and/or electrically connected to the connection contact at an axial and/or radial end section (28).

10. The apparatus according to claim 9, wherein the coil unit has no connection contact extending on the casing side and/or radially.

11. The apparatus according to claim 1, wherein the connection contact (26) and the flat end section (30) oriented thereto are provided in a radial edge region of the housing end region and are constructed so that an angling in a permanently connected state can take place with free ends in a direction of a radial centre of the end region.

12. The apparatus according to claim 1, wherein the housing end region is constructed for closing and/or covering by a housing cover (42) which, in an angled state of the connection contact and the flat end section, is able to be applied onto housing end region.

13. A use of the electromagnetic actuating apparatus according to claim 1 in an engine compartment of a motor vehicle and/or as a unit or mounting of an internal combustion engine, for adjusting of a motor vehicle engine component as the actuating partner.

14. The use according to claim 13, wherein the motor vehicle engine component is a cam shaft.

15. The use according to claim 13, wherein a plurality of the electromagnetic actuating apparatuses is provided adjacent to one another for interacting with the same actuating partner.

* * * * *